US008361687B2

(12) United States Patent
Ishiko et al.

(10) Patent No.: US 8,361,687 B2
(45) Date of Patent: Jan. 29, 2013

(54) ELECTROPHOTOGRAPHIC PHOTORECEPTOR, PROCESS CARTRIDGE AND IMAGE FORMING APPARATUS

(75) Inventors: Isamu Ishiko, Kanagawa (JP); Yoshifumi Shoji, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 340 days.

(21) Appl. No.: 12/871,300

(22) Filed: Aug. 30, 2010

(65) Prior Publication Data

US 2011/0236810 A1 Sep. 29, 2011

(30) Foreign Application Priority Data

Mar. 26, 2010 (JP) ..... 2010-073511

(51) Int. Cl.
*G03G 5/147* (2006.01)

(52) U.S. Cl. ..... 430/66; 430/59.6; 399/159

(58) Field of Classification Search ..... 430/59.6, 430/66; 399/159
See application file for complete search history.

(56) References Cited

U.S. PATENT DOCUMENTS 4,792,507 A 12/1988 Yoshihara et al.
5,162,183 A * 11/1992 Lindblad et al. ..... 430/58.8

FOREIGN PATENT DOCUMENTS

JP A-63-221355 9/1988
JP A-2006-267855 10/2006

* cited by examiner

*Primary Examiner* — Peter Vajda
(74) *Attorney, Agent, or Firm* — Oliff & Berridge, PLC

(57) ABSTRACT

The electrophotographic photoreceptor includes a substrate and a photosensitive layer disposed on the substrate, wherein a surface layer of the electrophotographic photoreceptor contains fluorine-containing polymer particles and a dispersion aid for the fluorine-containing polymer particles, and the surface layer has convex portions with diameters of from 200 μm to 500 μm spaced at an average interval of from 600 μm to 950 μm.

19 Claims, 5 Drawing Sheets

ELECTROPHOTOGRAPHIC PHOTORECEPTOR, PROCESS CARTRIDGE AND IMAGE FORMING APPARATUS

CROSS-REFERENCE TO RELATED APPLICATION

This application is based on and claims priority under 35 USC 119 from Japanese Patent Application No. 2010-073511 filed on Mar. 26, 2010.

BACKGROUND

1. Technical Field

The present invention relates to an electrophotographic photoreceptor, a process cartridge and an image forming apparatus.

2. Related Art

Image formation by an electrophotographic system is widely used in the fields of copying machines, laser beam printers, and the like, since this technique has such advantages as high speed and high quality printing. As an electrophotographic photoreceptor used in an image forming apparatus (hereinafter sometimes simply referred to as a "photoreceptor"), electrophotographic photoreceptors employing an organic photoconductive material, having such advantages as low-cost productivity and excellent disposability, have become the mainstream of electrophotographic photoreceptors, as compared with photoreceptors employing an inorganic photoconductive material. In particular, function-separate type organic photoreceptors, having a layered structure of a charge generation layer that generates charges when exposed to light and a charge transport layer that transports charges, exhibit excellent electrophotographic characteristics, and therefore, various proposals have been made for such function-separate type organic photoreceptors, which have been put to practical use.

SUMMARY

According to an aspect of the invention, there is provided an electrophotographic photoreceptor, including: a substrate and a photosensitive layer disposed on the substrate, wherein a surface layer of the electrophotographic photoreceptor contains fluorine-containing polymer particles and a dispersion aid for the fluorine-containing polymer particles, and the surface layer has convex portions with diameters of from 200 μm to 500 μm spaced at an average interval of from 600 μm to 950 μm.

BRIEF DESCRIPTION OF THE DRAWINGS

Exemplary embodiment of the present invention will be described in detail based on the following figures, wherein.

DETAILED DESCRIPTION

Figure 1:
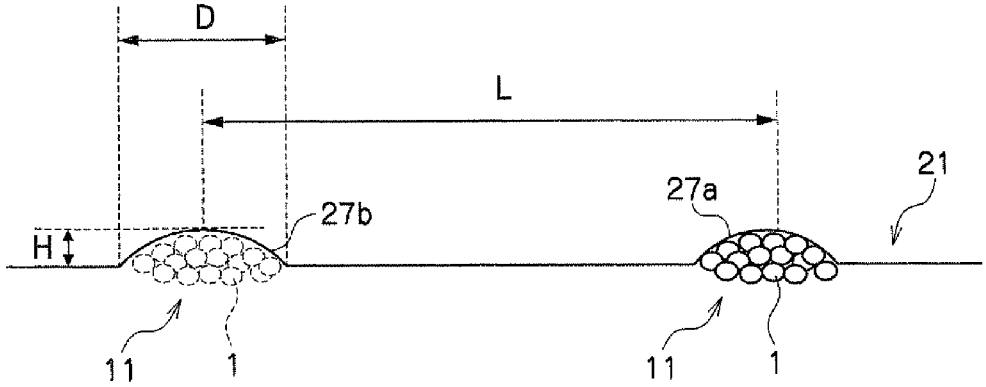
FIG. 1 is a view schematically showing the diameters of convex portions and the interval therebetween on the surface of an electrophotographic photoreceptor.

Hereinafter, exemplary embodiments of the present invention are described in detail.

The present inventors have found the following.

When a photosensitive layer of an electrophotographic photoreceptor is formed, for the purpose of realizing the photoreceptor having a long lifespan, incorporation of fluorine-containing polymer particles into a surface layer of the electrophotographic photoreceptor tends to result in uneven distribution of the fluorine-containing polymer particles in the surface layer. As a consequence, due to the aggregation of the fluorine-containing polymer particles, thickness of coating layer tends to be non-uniform, and it is difficult to obtain stable and favorable layer-forming properties. On the other hand, when layer-forming properties of the coating layer are excessively improved, uniformity of the surface layer of the electrophotographic photoreceptor is enhanced, which leads to an increase in static friction coefficient with the cleaning blade. As a result, noise is generated in the contact region between the cleaning blade and the photoreceptor when starting or stopping the image forming apparatus. For example, although suppression of leaking noise to the outside of the apparatus by adding noise-reducing means may be considered, it is difficult to achieve miniaturization of the apparatus while ensuring noise-reducing performance. Further, although roughening the surface of the photoreceptor is effective for the suppression of noise, roughening the surface of the photosensitive layer results in changes in abrasion state of the layer due to concentrated charge. Therefore non-uniformity of the charging performance occurs due to deterioration, which, in turn, makes it difficult to maintain the image quality.

The present inventors have made intensive studies regarding the above problems, and have found that the occurrence of noise due to contact between the photoreceptor and the cleaning blade and the deterioration of image quality in terms of line reproducibility due to deterioration of the charging performance of the photoreceptor resulting from surface irregularities after continuous printing are effectively suppressed in a photoreceptor in which fluorine-containing polymer particles are aggregated to a certain extent, and convex portions (mountains) due to such aggregation are formed on the surface within the specific range in the photoreceptor.

The electrophotographic photoreceptor according to the present exemplary embodiment includes a substrate and a photosensitive layer disposed on the substrate, a surface layer of the electrophotographic photoreceptor contains fluorine-containing polymer particles and a dispersion aid for the fluorine-containing polymer particles, and the surface layer of the electrophotographic photoreceptor has convex portions with diameters of 200 μm or more (or about 200 μm or more) spaced at an average interval of from 600 μm to 950 μm (or from about 600 μm to about 950 μm). The surface layer of the electrophotographic photoreceptor may have convex portions with diameters of from 200 μm to 500 μm (or from about 200 μm to about 500 μm) spaced at an average interval of from 600 μm to 950 μm (or from about 600 μm to about 950 μm). The surface layer is an outermost surface (layer) of the photoreceptor.

Here, the convex portions present on the surface layer, as shown in FIG. 1, aggregates 11 of fluorine-containing polymer particles 1 contained in the surface layer of the electrophotographic photoreceptor 21 may form a convex portion 27*a* such that the aggregates 11 are exposed on the surface layer, or may form a convex portion 27*b* such that the aggregates are covered by a binding polymer that forms a part of the surface layer.

Diameter D of the convex portion 27*a* or 27*b* on the surface layer refers to a diameter of the smallest circle surrounding the portion (convex portion) 27*a* or 27*b* risen from peripheries, when the surface of the electrophotographic photoreceptor 21 is observed under a light microscope.

In addition, an average interval between the convex portions 27*a* and 27*b* on the surface layer is a value which is calculated as an average value by measuring an interval L between a top of the convex portion 27*a* and a top of the convex portions 27*b* adjacent to each other, at four sites in the circumferential direction at each of three different locations at different distances from one end of the photoreceptor 21 in the axial direction, i.e., at a total of 12 sites, using a surface roughness meter. Specific measurement conditions are described in the Examples.

The layer constitution or the like of the electrophotographic photoreceptor 21 of the present exemplary embodiment is not particularly limited, as long as the surface layer contains fluorine-containing polymer particles 1 and a dispersion aid for the fluorine-containing polymer particles 1. The photosensitive layer according to the present exemplary embodiment may be a functionally-integrated photosensitive layer having both a charge transporting function and a charge generating function, or may be a functionally-separated photosensitive layer having a charge transport layer and a charge generation layer. Further, if necessary, other layers such as an undercoat layer, an intermediate layer, an overcoat layer and the like may be provided to the photoreceptor.

In the electrophotographic photoreceptor of the present exemplary embodiment, when a functionally-integrated photosensitive layer serves as a surface layer, the fluorine-containing polymer particles and the dispersion aid are contained in the functionally-integrated photosensitive layer. When one of a charge transport layer and a charge generation layer included in a functionally-separated photosensitive layer serves as a surface layer, the fluorine-containing polymer particles and the dispersion aid are contained in the layer corresponding to the surface layer. Furthermore, when an overcoat layer as a surface layer is provided on a photosensitive layer, the fluorine-containing polymer particles and the dispersion aid are contained in the overcoat layer. Since the overcoat layer is thin as compared to the photosensitive layer, the fluorine-containing polymer particles and the dispersion aid may be additionally contained in the photosensitive layer which is a layer underneath the overcoat layer.

Figure 2:
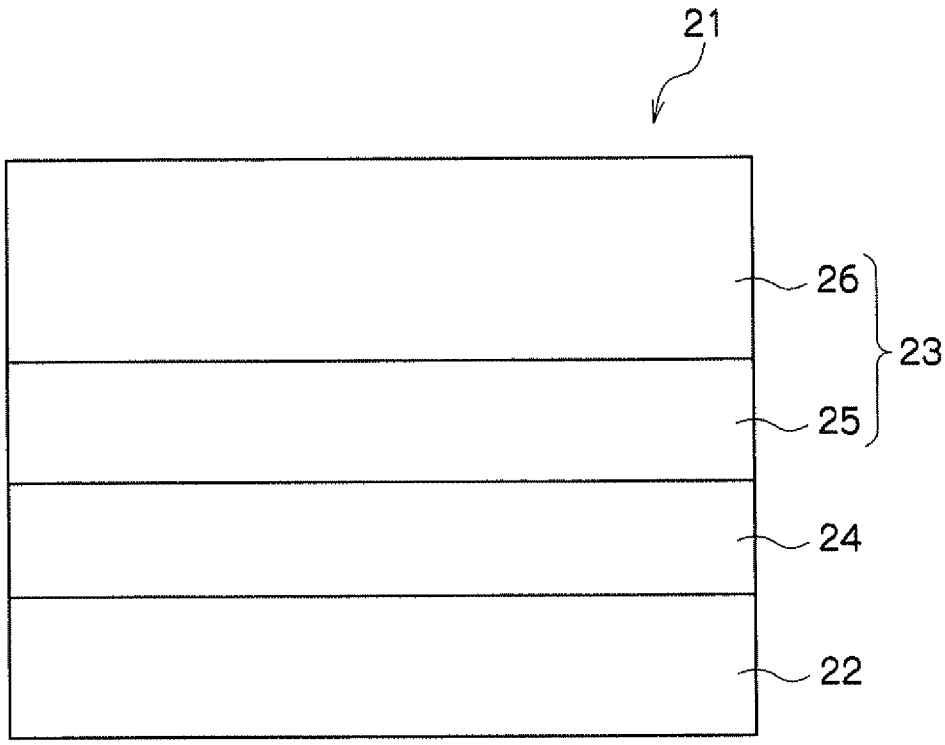
FIG. 2 is a schematic constitutional view showing an example of an electrophotographic photoreceptor according to an exemplary embodiment of the present invention.

FIG. 2 is a schematic cross-sectional view showing an example of the constitution of the electrophotographic photoreceptor according to the present exemplary embodiment. The electrophotographic photoreceptor 21 has a structure in which an undercoat layer 24, a charge generation layer 25, and a charge transport layer 26 are laminated in this order on a substrate 22, and the charge generation layer 25 and the charge transport layer 26 form a functionally-separated photosensitive layer 23. In FIG. 2, the charge transport layer 26 serves as a surface layer (a layer positioned at an outermost side from the substrate 22) in the electrophotographic photoreceptor 21. The electrophotographic photoreceptor 21 has a configuration such that the fluorine-containing polymer particles and the dispersion aid are contained in the charge transport layer 26, convex portions having diameters of from 200 μm to 500 μm are present on the surface, and an average interval between the convex portions is in the range of from 600 μm to 950 μm.

Hereafter, individual elements of the electrophotographic photoreceptor 21 are explained.

Substrate

Any conventionally used conductive material may be used as a material for forming a substrate 22. As used herein, the term "conductive" or "conductivity" refers to the range of $10^6$ Ωcm or less in terms of volume resistivity.

Examples of the materials include metals such as aluminum, nickel, chromium, or stainless steel; plastic films provided with a thin layer of aluminum, titanium, nickel, chromium, stainless steel, gold, vanadium, tin oxide, indium oxide, ITO or the like; paper coated with or impregnated with a conductivity-imparting agent; and plastic films.

The shape of the substrate 22 is not limited to a drum, and may be a sheet or a plate.

When a metal pipe is used as the substrate 22, the surface of the pipe may be in an untreated state, or may be subjected to a pre-treatment such as mirror surface cutting, etching, anodic oxidation, rough cutting, centerless grinding, sandblast, wet honing or the like.

Undercoat Layer

The undercoat layer 24 may be provided for the purpose of preventing light reflection at the surface of the substrate 22, or preventing inflow of unnecessary carriers from the substrate 22 to the photosensitive layer 23, or the like, as necessary. The undercoat layer 24 may be prepared by coating a substrate with a composition dispersing a material for the undercoat layer 24 in a binder polymer. Examples of the material for the undercoat layer 24 includes a metal powder of aluminum, copper, nickel, or silver; a conductive metal oxide such as antimony oxide, indium oxide, tin oxide, or zinc oxide; and a conductive material such as carbon fiber, carbon black, or graphite powder. Further, two or more kinds of metal oxide particles may be mixed and used. Moreover, metal oxide particles may be subjected to a surface treatment with a coupling agent in order to adjust the powder resistance thereof.

Examples of the binder polymers contained in the undercoat layer 24 include known polymer compounds such as an acetal polymer (for example, polyvinyl butyral), a polyvinyl alcohol polymer, casein, a polyamide polymer, a cellulose polymer, gelatin, a polyurethane polymer, a polyester polymer, a methacrylic polymer, an acrylic polymer, a polyvinyl chloride polymer, a polyvinyl acetate polymer, a vinyl chloride-vinyl acetate-maleic anhydride polymer, a silicone polymer, a silicone-alkyd polymer, a phenol polymer, a phenol-formaldehyde polymer, a melamine polymer, or a urethane polymer; charge transporting polymers having a charge transporting group; and conductive polymers such as polyaniline. Among them, polymers that are insoluble in a coating solvent used for forming an upper layer (charge generation layer 25 of the photoreceptor shown in FIG. 2) are preferably used. In particular, a thermosetting polymer (such as a phenol polymer, a phenol-formaldehyde polymer, a melamine polymer, a urethane polymer, or an epoxy polymer) or a polymer in which an acetal polymer (such as polyvinyl butyral) is cured by an isocyanate compound is preferably used.

The ratio of the metal oxide particles to the binder polymer in the undercoat layer 24 may be arbitrarily determined without being particularly limited, as long as desired characteristics of the electrophotographic photoreceptor can be obtained.

When forming the undercoat layer 24, a coating liquid prepared by adding the above-mentioned components to a solvent is used. Examples of the solvent include organic solvents (for example, aromatic hydrocarbon solvents such as toluene or chlorobenzene; aliphatic alcohol solvents such as methanol, ethanol, n-propanol, iso-propanol, or n-butanol;

ketone solvents such as acetone, cyclohexanone, or 2-butanone; halogenated aliphatic hydrocarbon solvents such as methylene chloride, chloroform or ethylene chloride; cyclic or straight-chain ether solvents such as tetrahydrofuran, dioxane, ethylene glycol, or diethyl ether; and ester solvents such as methyl acetate, ethyl acetate or n-butyl acetate). These solvents may be used alone, or two or more kinds of solvents may be mixed and used. When two or more kinds of solvents are mixed and used, any solvent may be used as long as the mixture of the solvent is capable of dissolving the binder polymer.

Further, examples of methods of dispersing metal oxide particles in a coating liquid for forming an undercoat layer include methods of using media dispersing machines such as a ball mill, a vibration ball mill, an attritor, a sand mill or a horizontal sand mill; and methods of using medialess dispersing machines such as a stirrer, an ultrasonic dispersing machine, a roll mill, or a high-pressure homogenizer. Further, the high-pressure homogenizer includes a collision system in which a dispersion liquid is dispersed under high pressure by liquid-liquid collision or liquid-wall collision; and a passing-through system in which a dispersion liquid is dispersed by passing the dispersion liquid through a fine flow path under high pressure.

Examples of methods of applying the thus obtained coating liquid for forming the undercoat layer onto the substrate 22 include a dip coating method, an extrusion coating method, a wire bar coating method, a spray coating method, a blade coating method, a knife coating method, and a curtain coating method. The thickness of the undercoat layer 24 is preferably 15 μm or more, and more preferably from 20 μm to 50 μm. Polymer particles may also be added to the undercoat layer 24, in order to adjust the surface roughness of the undercoat layer 24. As the polymer particles, silicone polymer particles, crosslinked poly(methyl methacrylate) (PMMA) polymer particles, or the like may be used.

Further, the surface of the undercoat layer 24 may be polished for adjusting the surface roughness. As the polishing method, a buff polishing, a sandblast treatment, a wet honing, a grinding treatment or the like may be used.

Intermediate Layer

Although not shown in the drawings, an intermediate layer may be further provided on the undercoat layer 24 in order to improve electrical properties, image quality, image quality maintainability, adhesion to the photosensitive layer 23, and the like. Examples of the binder polymer used in the intermediate layer include organic metal compounds containing zirconium atoms, titanium atoms, aluminum atoms, manganese atoms, or silicon atoms; and polymer compounds such as an acetal polymer (for example, polyvinyl butyral), a polyvinyl alcohol polymer, casein, a polyamide polymer, a cellulose polymer, gelatin, a polyurethane polymer, a polyester polymer, a methacrylic polymer, an acrylic polymer, a polyvinyl chloride polymer, a polyvinyl acetate polymer, a vinyl chloride-vinyl acetate-maleic anhydride polymer, a silicone polymer, a silicone-alkyd polymer, a phenol-formaldehyde polymer, or a melamine polymer. These compounds may be used alone, may be used as a mixture of plural compounds, or may be used as a polycondensation product of plural compounds. Among them, organic metal compounds containing zirconium or silicon exhibit excellent characteristics such as a low residual potential, a small potential fluctuation due to environment, and a small change in potential due to repetitive use.

Solvents used for forming the intermediate layer include known organic solvents. Examples of the known organic solvents include aromatic hydrocarbon solvents such as toluene or chlorobenzene; aliphatic alcohol solvents such as methanol, ethanol, n-propanol, iso-propanol or n-butanol; ketone solvents such as acetone, cyclohexanone, or 2-butanone; halogenated aliphatic hydrocarbon solvents such as methylene chloride, chloroform or ethylene chloride; cyclic or straight-chain ether solvents such as tetrahydrofuran, dioxane, ethylene glycol, or diethyl ether; and ester solvents such as methyl acetate, ethyl acetate or n-butyl acetate. These solvents may be used alone or two or more kinds of solvents may be mixed and used. When two or more kinds of solvents are mixed, any solvent may be used as long as the mixture of the solvents is capable of dissolving the binder polymer.

Examples of coating methods for forming the intermediate layer include common methods such as a dip coating method, an extrusion coating method, a wire bar coating method, a spray coating method, a blade coating method, a knife coating method, or a curtain coating method.

The intermediate layer serves also as an electric blocking layer, in addition to serving to improve a coating property of the upper layer. However, when the thickness of the intermediate layer is too thick, desensitization may occur due to an excessively strong electric hindrance or an increase in an electric potential due to repetitive use may occur. Accordingly, from viewpoints of above, when forming the intermediate layer, the thickness thereof is preferably in the range of from 0.1 μm to 3 μm. Further, in this case, the intermediate layer may be used as the undercoat layer 24.

Charge Generation Layer

The charge generation layer 25 is formed by dispersing a charge generating material in a binder polymer. Examples of the charge generating material include phthalocyanine pigments such as metal-free phthalocyanine, chlorogallium phthalocyanine, hydroxygallium phthalocyanine, dichloro tinphthalocyanine, or titanyl phthalocyanine. In particular, chlorogallium phthalocyanine crystals having intense diffraction peaks at least at 7.4°, 16.6°, 25.5° and 28.3° of Bragg angles (2θ±0.2°) relative to CuKα characteristic X rays; metal-free phthalocyanine crystals having intense diffraction peaks at least at 7.7°, 9.3°, 16.9°, 17.5°, 22.4° and 28.8° of Bragg angles (2θ+0.2°) relative to CuKα characteristic X rays; hydroxygallium phthalocyanine crystals having intense diffraction peaks at least at 7.5°, 9.9°, 12.5°, 16.3°, 18.6°, 25.1° and 28.3° of Bragg angles (2θ±0.2°) relative to CuKα characteristic X rays; and titanyl phthalocyanine crystals having intense diffraction peaks at least at 9.6°, 24.1° and 27.2° of Bragg angles (2θ±0.2°) relative to CuKα characteristic X rays may be used. In addition, other charge generating materials, such as a quinone pigment, a perylene pigment, an indigo pigment, a bisbenzoimidazole pigment, an anthrone pigment, a quinacridone pigment, and the like, may also be used. Further, these charge generating materials may be used alone or two or more of the charge generating materials may be mixed and used.

Examples of the binder polymer used in the charge generation layer 25 include polycarbonate polymers such as bisphenol type A or bisphenol type Z, an acrylic polymer, a methacrylic polymer, a polyarylate resin, a polyester resin, a polyvinyl chloride resin, a polystyrene resin, an acrylonitrile-styrene copolymer, an acrylonitrile-butadiene copolymer, a polyvinyl acetate resin, a polyvinyl formal resin, a polysulfone resin, a styrene-butadiene copolymer, a vinylidene chloride-acrylonitrile copolymer, a vinyl chloride-vinyl acetate-maleic anhydride polymer, a silicone polymer, a phenol-formaldehyde polymer, a polyacrylamide resin, a polyamide resin, and a poly-N-vinylcarbazole resin. These binder polymers may be used alone or two or more of the binder polymers may be mixed and used. The compounding ratio of the charge generating material to the binder polymer is preferably in the range of 10:1 to 1:10 in weight ratio.

When the charge generation layer 25 is formed, a coating liquid in which the above-mentioned components has been added to a solvent is used. Examples of the solvent include organic solvents (for example, aromatic hydrocarbon solvents such as toluene or chlorobenzene; aliphatic alcohol solvents such as methanol, ethanol, n-propanol, iso-propanol or n-butanol; ketone solvents such as acetone, cyclohexanone, or 2-butanone; halogenated aliphatic hydrocarbon solvents such as methylene chloride, chloroform or ethylene chloride; cyclic or straight-chain ether solvents such as tetrahydrofuran, dioxane, ethylene glycol, or diethyl ether; and ester solvents such as methyl acetate, ethyl acetate or n-butyl acetate). These solvents may be used alone or two or more of the solvents may be mixed and used. When two or more kinds of solvents are mixed, any solvent may be used as long as the mixture of the solvents is capable of dissolving the binder polymer.

In order to disperse a charge generating material in a polymer, a coating liquid is subjected to a dispersing treatment. Examples of a method of dispersing the charge generating material in a polymer include methods of using media dispersing machines such as a ball mill, a vibration ball mill, an attritor, a sand mill or a horizontal sand mill, and methods of using medialess dispersing machines such as a stirrer, an ultrasonic dispersing machine, a roll mill, or a high-pressure homogenizer. Further, examples of the high-pressure homogenizer include a collision system in which a dispersion liquid is dispersed by liquid-liquid collision or liquid-wall collision under high pressure, and a passing through system in which a dispersion liquid is dispersed by passing the dispersion liquid through a fine flow path under high pressure.

Examples of methods of applying the thus obtained coating liquid onto the undercoat layer 24 include a dip coating method, an extrusion coating method, a wire bar coating method, a spray coating method, a blade coating method, a knife coating method, and a curtain coating method. The thickness of the charge generation layer 25 is preferably in the range of from 0.01 μm to 5 μm, and more preferably from 0.05 μm to 2.0 μm.

Charge Transport Layer

In FIG. 2, the charge transport layer 26 corresponds to the surface layer of the electrophotographic photoreceptor 21, and contains fluorine-containing polymer particles and a dispersion aid for the fluorine-containing polymer particles. According to the experiments conducted by the present inventors, the fluorine-containing polymer particles and the dispersion aid contained in the surface layer are main control factors for the size of the convex portions or an interval therebetween on the surface of the electrophotographic photoreceptor. In particular, the size of the convex portions and the interval therebetween due to aggregation of the fluorine-containing polymer particles are controlled by adjusting a kind, an average primary particle diameter, or content of fluorine-containing polymer particles, a kind, content of the dispersion aid, and by optimizing conditions (for example, the number of treatment performed or the like) when performing dispersion.

The charge transport layer contains fluorine-containing polymer particles and a dispersion aid for the fluorine-containing polymer particles, and has convex portions having diameters of from 200 μm to 500 μm spaced at an average interval of from 600 μm to 950 μm on the surface. Further, from the viewpoint of more effectively suppressing the occurrence of noise due to contact with the cleaning blade, an average of diameters D of the convex portions is preferably from 200 μm to 350 μm (or from about 200 μm to about 350 μm), and more preferable from 200 μm to 250 μm (or from about 200 μm to about 250 μm).

Further, a height H of the convex portions on the surface is not particularly limited as long as image formation is not hindered. From the viewpoint of preventing poor cleaning properties due to toner escape, the height H of the convex portions is preferably in the range of from 1 μm to 10 μm.

Fluorine-containing Polymer Particles

The fluorine-containing polymer particles are preferably at least one or two or more selected from a tetrafluoroethylene polymer (PTFE), a trifluoroethylenechloride polymer, a hexafluoropropylene polymer, a vinyl fluoride polymer, a vinylidene fluoride polymer, dichlorodifluoroethylene polymer or a copolymer thereof, more preferably a tetrafluoroethylene polymer or a vinylidene fluoride polymer, and particularly preferably a tetrafluoroethylene polymer. When the fluorine-containing polymer particles of the present exemplary embodiment contain a tetrafluoroethylene polymer, an effect of abrasion resistance may be achieved.

The average primary particle diameter of the fluorine-containing polymer particles is preferably in the range of from 0.01 μm to 0.04 μm (or from about 0.01 μm to about 0.04 μm), and more preferably from 0.02 μm to 0.03 μm (or from about 0.02 μm to about 0.03 μm).

In the present exemplary embodiment, the average primary particle diameter of the fluorine-containing polymer particles is determined by measuring a measurement liquid diluted with a solvent that is the same as the solvent used in the dispersion liquid in which the fluorine-containing polymer particles has been dispersed, using a laser diffraction particle size distribution analyzer LA-700 (manufactured by Horiba Ltd.) at a refractive index of 1.35.

The content of the fluorine-containing polymer particles relative to the total solid content of the surface layer, i.e., the charge transport layer 26, is preferably in the range of from 1% by weight to 15% by weight (or from about 1% by weight to about 15% by weight), and more preferably from 2% by weight to 12% by weight (or from about 2% by weight to about 12% by weight). When the content of the fluorine-containing polymer particles is in the range of from 1% by weight to 15% by weight (or from about 1% by weight to about 15% by weight), convex portions having diameters of from 200 μm to 500 μm may be easily formed due to aggregation of the fluorine-containing polymer particles on the surface and an average interval between the convex portions may be easily adjusted to the range of from 600 μm to 950 μm. When the content of the fluorine-containing polymer particles is 1% by weight or more (or about 1% by weight or more), surface energy of the charge transport layer 26 may be decreased and durability of the electrophotographic photoreceptor may be improved. On the other hand, when the content of the fluorine-containing polymer particles is 15% by weight or less (or about 15% by weight or less), decreases in light transmittance and layer strength do not readily occur.

Dispersion Aid

As used herein, the term "dispersion aid" for fluorine-containing polymer particles refers to a compound which has a function of improving dispersibility of fluorine-containing polymer particles such as PTFE particles, and retains compatibility with a binding polymer contained in the outermost surface layer while maintaining adsorptivity to the surface of the fluorine-containing polymer particles.

Examples of the dispersion aid include a fluorine-containing surfactant, a fluorine-containing polymer, a silicone polymer, and silicone oil. Among them, a fluorine-containing polymer is preferable, and a fluorine-containing comb-shaped graft polymer is further preferable. The fluorine-containing comb-shaped graft polymer is preferably a graft polymer which is synthesized by, for example, graft polymerization using a macro monomer (for example, an acrylic acid ester compound, a methacrylic acid ester compound or the like), and a perfluoroalkyl ethyl (meth)acrylate, a perfluoroalkyl (meth)acrylate, or the like. Here, the term "(meth)acrylate" refers to either an acrylate or a methacrylate.

Among them, the dispersion aid is particularly preferably a fluoroalkyl group-containing copolymer containing repeating units represented by the following chemical formula (1) and chemical formula (2), which is sometimes referred to as "specific copolymer" in the present specification.

CHEMICAL FORMULA (1)

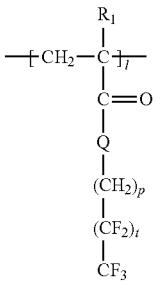

CHEMICAL FORMULA (2)

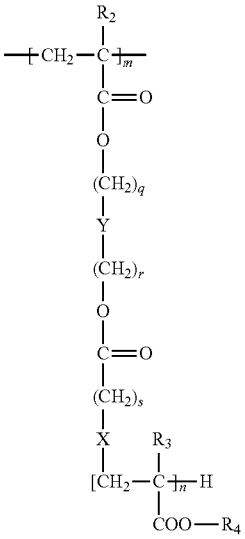

In chemical formula (1) and chemical formula (2), l, m and n each independently represent a positive integer of 1 or more, p, q, r and s each independently represent 0 or a positive integer of 1 or more, t represents a positive integer of from 2 to 7, $R^1$, $R^2$, $R^3$ and $R^4$ each independently represent a hydrogen atom or an alkyl group, X represents an alkylene chain, a halogen-substituted alkylene chain, —S—, —O—, —NH— or a single bond, and Y represents an alkylene chain, a halogen-substituted alkylene chain, —($C_zH_{2z-1}$(OH))— or a single bond. z represents a positive integer of 1 or more. Q represents —O—.

When t in chemical formula (1) is less than 2, adsorptivity of the graft polymer to the fluorine-containing polymer particles may be deteriorated and function of the graft polymer as the dispersion aid may be deteriorated. When dispersibility of the fluorine-containing polymer particles is decreased, distribution of fluorine-containing polymer particles present in the surface layer becomes uneven; therefore, it may be difficult to achieve sufficient durability-improving effects on the electrophotographic photoreceptor.

Further, when t in chemical formula (1) is 8 or more, compatibility of the fluorine-containing graft polymer with a binder polymer contained in the surface layer may be deteriorated. As a result, the interface between the fluorine-containing graft polymer and the binder polymer may serve as trap sites, causing decrease in image density due to increase in residual potential when repetitively used at high temperature and high humidity.

On the other hand, when t in chemical formula (1) is in the range of from 2 to 7, compatibility of the specific polymer with the binder polymer contained in the surface layer may be achieved while maintaining adsorptivity of the specific copolymer to the fluorine-containing polymer particles. A preferable range of t in chemical formula (1) is from 2 to 6.

In chemical formula (1) and chemical formula (2), examples of the alkyl group represented by $R^1$, $R^2$, $R^3$ and $R^4$ include a methyl group, an ethyl group, and a propyl group. $R^1$, $R^2$, $R^3$ and $R^4$ each independently represent preferably a hydrogen atom or a methyl group, and more preferably a methyl group.

In the specific copolymer, the content ratio of chemical formula (1) to chemical formula (2), i.e., the ratio of l:m, is preferably from 1:9 to 9:1, and more preferably from 3:7 to 7:3, from the viewpoint of aggregating the fluorine-containing polymer particles to a certain extent. When the ratio of l:m is in the range of from 3:7 to 7:3, tetrafluoroethylene polymer particles can be favorably dispersed, the polymer particles can be readily aggregated to a certain extent, and surface irregularities can be easily regulated.

The content of the specific copolymer (the dispersion aid) in the surface layer, in this case a charge transport layer 26, is preferably from 1% by weight to 5% by weight (or from about 1% by weight to about 5% by weight) relative to the content (by weight) of the fluorine-containing polymer particles in the surface layer.

When the content of the specific copolymer is in the above-specified range, the fluorine-containing polymer particles may appropriately aggregate. Further, when the content of the specific copolymer is 1% by weight or more (or about 1% by weight or more), the fluorine-containing polymer particles may be uniformly dispersed in the charge transport layer. When the content of the specific copolymer is 5% by weight or less (or about 5% by weight or less), the amount of the specific copolymer which is not adsorbed to the surface of the fluorine-containing polymer particles may be reduced in the charge transport layer, thereby suppressing generation of trap sites for electric charges caused by the presence of the specific copolymer in a free state. As a result, increase in the residual potential and decrease in density do not readily occur even after repetitive use at high temperature and high humidity.

The charge transport layer 26 contains a charge transport material, which serves to exert the essential function as a charge transport layer 26, and a binder polymer, in addition to the above-described components. Examples of the charge transport material include hole transport materials such as oxadiazole derivatives (for example, 2,5-bis(p-diethylaminophenyl)-1,3,4-oxadiazole); pyrazoline derivatives (for example, 1,3,5-triphenyl-pyrazoline and 1-[pyridyl-(2)]-3-(p-diethylaminostyryl)-5-(p-diethylaminostyryl)pyrazoline); aromatic tertiary amino compounds (for example, triphenylamine, N,N'-bis(3,4-dimethylphenyl)biphenyl-4-amine, tri(p-methylphenyl)aminyl-4-amine and dibenzyl aniline); aromatic tertiary diamino compounds (for example, N,N'-bis(3-methylphenyl)-N,N'-diphenyl benzidine); 1,2,4-triazine derivatives (for example, 3-(4'-dimethylaminophenyl)-5,6-di-(4'-methoxyphenyl)-1,2,4-triazine); hydrazone derivatives (for example, 4-diethylaminobenzaldehyde-1,1-diphenyl hydrazone); quinazoline derivatives (for example, 2-phenyl-4-styryl-quinazoline); benzofuran derivatives (for example, 6-hydroxy-2,3-di(p-methoxyphenyl)benzofuran); α-stilbene derivatives (for example, p-(2,2-diphenylvinyl)-N,N-diphenyl aniline); enamine derivatives; carbazole derivatives (for example, N-ethylcarbazole); or poly-N-vinylcarbazole and derivatives thereof; electron transport materials such as quinone compounds (for example, chloranil and bromoanthraquinone); tetracyanoquinodimethane compounds; fluorenone compounds (for example, 2,4,7-trinitrofluorenone and 2,4,5,7-tetranitro-9-fluororenone); xanthone compounds; or thiophene compounds, and polymers having a group which includes the above-mentioned compounds in the main chain or a side chain thereof. These charge transport materials may be used alone or in a combination of two or more thereof.

Further, examples of the binder polymer used in the charge transport layer 26 include insulative polymers such as a polycarbonate polymer (for example, bisphenol type A and bisphenol type Z), an acrylic polymer, a methacrylic polymer, a polyarylate resin, a polyester resin, a polyvinyl chloride resin, a polystyrene resin, an acrylonitrile-styrene copolymer, an acrylonitrile-butadiene copolymer, a polyvinyl acetate resin, a polyvinyl formal resin, a polysulfone resin, a styrene-butadiene copolymer, a vinylidene chloride-acrylonitrile copolymer, a vinyl chloride-vinyl acetate-maleic anhydride polymer, a silicone polymer, a phenol-formaldehyde polymer, a polyacrylamide resin, a polyamide polymer or a chlorinated rubber; and organic photoconductive polymers such as polyvinyl carbazole, polyvinyl anthracene or polyvinyl pyrene. These binder polymers may be used alone or two or more of the binder polymers may be mixed and used.

The charge transport layer 26 is formed with a coating liquid in which the above components are added to a solvent. Examples of the solvent used for forming the charge transport layer 26 include known organic solvents such as aromatic hydrocarbon solvents (for example, toluene and chlorobenzene); aliphatic alcohol solvents (for example, methanol, ethanol, n-propanol, iso-propanol, and n-butanol); ketone solvents (for example, acetone, cyclohexanone, and 2-butanone); halogenated aliphatic hydrocarbon solvents (for example, methylene chloride, chloroform and ethylene chloride); cyclic or straight-chain ether solvents (for example, tetrahydrofuran, dioxane, ethylene glycol, and diethyl ether); or ester solvents (for example, methyl acetate, ethyl acetate and n-butyl acetate). These solvents may be used alone or two or more of the solvents may be mixed and used. When two or more kinds of solvents are used, any solvent may be used as long as the mixed solvent is capable of dissolving the binder polymer. The compounding ratio of the charge transport material to the binder polymer is preferably in the range of from 10:1 to 1:5.

The electrophotographic photoreceptor is generally manufactured by a dip coating method, and it is important to form a smooth surface layer in order to obtain a favorable image. Since an organic solvent is used in the coating liquid, an orange peel phenomenon or the like may occur on the surface when dried. In order to prevent such a phenomenon, a leveling agent is often used. As the leveling agent, dimethyl silicone oil is commonly used.

Examples of a method of dispersing the fluorine-containing polymer particles in a charge transport layer-forming coating liquid used for forming the charge transport layer 26 include methods of using media dispersing machines such as a ball mill, a vibration ball mill, an attritor, a sand mill or a horizontal sand mill, and methods of using medialess dispersing machines such as a stirrer, an ultrasonic dispersing machine, a roll mill, or a high-pressure homogenizer. Further, examples of the high-pressure homogenizer includes a collision system in which a dispersion liquid is dispersed by liquid-liquid collision or liquid-wall collision under high pressure, and a passing through system in which a dispersion liquid is dispersed by passing the dispersion liquid through a fine flow path under high pressure.

In the present exemplary embodiment, the method for preparing the coating liquid for forming the charge transport layer is not specifically limited. The coating liquid may be prepared by mixing the fluorine-containing polymer particles, the specific copolymer, the binder polymer, the charge transport material, the solvent, and optionally other components with the above-mentioned dispersing machine. Alternatively, the coating liquid may be prepared by separately preparing two liquids, i.e. a mixed liquid A containing the fluorine-containing polymer particles, the specific copolymer and the solvent, and a mixed liquid B containing the binder polymer, the charge transport material and the solvent, and then mixing the liquid A and liquid B. By mixing the fluorine-containing polymer particles and the specific copolymer in the solvent, the specific copolymer can be sufficiently adhered to the surface of the fluorine-containing polymer particles.

The coating liquid for forming the charge transport layer may be prepared by mixing the above-mentioned mixed liquid B with a mixed liquid A' which is obtained by adding the fluorine-containing polymer particles and the specific copolymer to the solvent containing the binder polymer. When the charge transport layer 26 is formed with the coating liquid for forming the charge transport layer prepared using the mixed liquid A' which is obtained by adding the fluorine-containing polymer particles and the specific copolymer to the solvent already containing the binder polymer, sensitivity of the obtained electrophotographic photoreceptor is enhanced.

The amount of the binder polymer contained in the mixed liquid A' is preferably from 1% by weight to 70% by weight, and more preferably from 5% by weight to 30% by weight relative to the amount of the fluorine-containing polymer particles.

The thus obtained coating liquid for forming the charge transport layer can be applied onto the charge generation layer 25 by a conventional method such as a dip coating method, an extrusion coating method, a wire bar coating method, a spray coating method, a blade coating method, a knife coating method, or a curtain coating method.

The thickness of the charge transport layer 26 is preferably in the range of from 5 μm to 50 μm, and more preferably in the range of from 10 μm to 40 μm, from the viewpoint of practicality.

For the purpose of preventing deterioration of the photoreceptor due to light or heat, or due to ozone or nitrogen oxide that is generated in an image forming apparatus, additives such as an antioxidant, a light stabilizer or a heat stabilizer may be added into each of the layers included in the photosensitive layer 23. Examples of the antioxidant include hindered phenol, hindered amine, paraphenylene diamine, arylalkane, hydroquinone, spirochroman, spiroindanone and derivatives thereof, an organic sulfur compound and an organic phosphorous compound. Examples of the light stabilizer include derivatives of benzophenone, benzoazole, dithiocarbamate and tetramethylpiperidine.

In the electrophotographic photoreceptor of the present exemplary embodiment, an overcoat layer may be provided as a surface layer. The overcoat layer is used to prevent chemical changes of the charge transport layer 26 when charging the electrophotographic photoreceptor, or to further improve the mechanical strength of the photosensitive layer. The overcoat layer may be formed by applying, onto the photosensitive layer, a coating liquid in which a conductive material is contained in a suitable binder polymer.

When an overcoat layer is provided as a surface layer, the electrophotographic photoreceptor has a configuration such that the overcoat layer contains fluorine-containing polymer particles and a dispersion aid for the fluorine-containing polymer particles, and has convex portions having diameters of from 200 μm to 500 μm spaced at an average interval of from 600 μm to 950 μm on the surface.

The conductive material contained in the overcoat layer is not particularly limited, and examples thereof include metallocene compounds such as N,N'-dimethylferrocene; aromatic amine compounds such as N,N'-diphenyl-N,N-bis(3-methylphenyl)-[1,1'-biphenyl]-4,4'-diamine; molybdenum oxide, tungsten oxide, antimony oxide, tin oxide, titanium oxide, indium oxide; carriers of a solid solution of tin oxide and antimony or carriers of a solid solution of barium sulfate and antimony oxide; mixtures of the above metal oxides; materials formed by mixing the above metal oxides in single particles of titanium oxide, tin oxide, zinc oxide, or barium sulfate; and materials formed by coating single particles of titanium oxide, tin oxide, zinc oxide, or barium sulfate with the above metal oxides.

Examples of the binder polymer used in the overcoat layer include known polymers such as a polyamide resin, a polyvinylacetal resin, a polyurethane resin, a polyester resin, an epoxy polymer, a polyketone resin, a polycarbonate resin, a polyvinyl ketone resin, a polystyrene resin, a polyacrylamide resin, a polyimide resin and a polyamideimide resin. These polymers may also be crosslinked each other and used, if needed.

The thickness of the overcoat layer is preferably from 1 μm to 20 μm, and more preferably from 2 μm to 10 μm.

The methods of coating the coating liquid for forming the overcoat layer include usual methods such as a blade coating method, a wire bar coating method, a spray coating method, a dip coating method, a bead coating method, an air knife coating method, and a curtain coating method. Examples of solvents used for the coating liquid for forming the overcoat layer include conventional organic solvents such as dioxane, tetrahydrofuran, methylene chloride, chloroform, chlorobenzene and toluene. These solvents may be used alone or two or more of the solvents may be mixed and used. It is preferred to use solvents that have a tendency to hardly dissolve the photosensitive layer to which the coating liquid is applied.

Image Forming Apparatus

The image forming apparatus of the present exemplary embodiment includes the electrophotographic photoreceptor of the present exemplary embodiment; a charging unit that charges the electrophotographic photoreceptor; a latent image forming unit that forms a latent image on the surface of the charged electrophotographic photoreceptor; a developing unit that forms a toner image by developing the latent image formed on the surface of the electrophotographic photoreceptor with a developer containing a toner; a transferring unit that transfers, to a transfer medium, the toner image formed on the surface of the electrophotographic photoreceptor; and a cleaning unit having a cleaning blade for removing residual toner that remains on the surface of the electrophotographic photoreceptor after transferring the toner image to the transfer medium.

Figure 3:
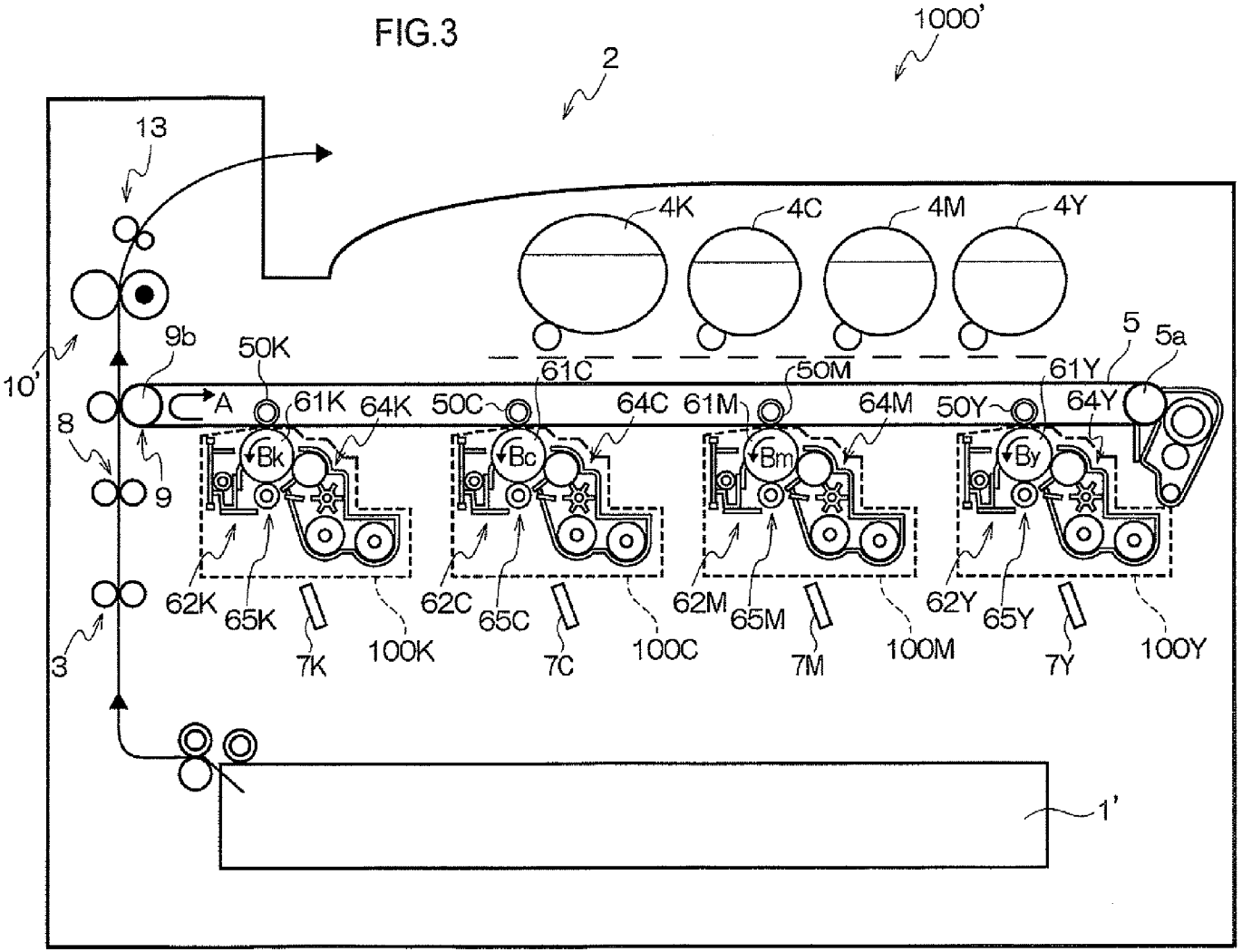
FIG. 3 is a schematic constitutional view showing an example of an image forming apparatus according to an exemplary embodiment of the present invention.

FIG. 3 is an overall constitution view showing an example of an image forming apparatus having the electrophotographic photoreceptor of the present exemplary embodiment.

The image forming apparatus 1000' of the present exemplary embodiment is a color printer for a single-side output.

The image forming apparatus 1000' is equipped with electrophotographic photoreceptors 61K, 61C, 61M and 61Y that are rotated in directions indicated by arrows Bk, Bc, Bm and By, respectively, as shown in FIG. 3. Each of the photoreceptors 61K, 61C, 61M and 61Y corresponds to an example of the electrophotographic photoreceptor of the present exemplary embodiment.

On the periphery of each photoreceptor 61K, 61C, 61M and 61Y are provided charging members 65K, 65C, 65M and 65Y as charging units that charge the surfaces of the photoreceptors, respectively, by rotating while contacting each photoreceptor; each of the exposure units 7K, 7C, 7M and 7Y as an electrostatic latent image-forming unit that forms an electrostatic latent image for each color of black (K), cyan (C), magenta (M) and yellow (Y) by irradiating each of the charged photoreceptors with laser light; and developing units 64K, 64C, 64M and 64Y as image forming units that develop the electrostatic latent images formed on the respective photoreceptors with developers containing toners of respective colors, thereby forming a toner image of respective colors.

In individual components of the image forming apparatus 1000', the charging member 65K, the photoreceptor 61K, the cleaning unit 62K, and the developing unit 64K for a black color are integrated to form a process cartridge 100K. Similarly, the charging member 65C, the photoreceptor 61C, the cleaning unit 62C, and the developing unit 64C for a cyan color are integrated to form a process cartridge 100C, the charging member 65M, the photoreceptor 61M, the cleaning unit 62M, and the developing unit 64M for a magenta color are integrated to form a process cartridge 100 M, and the charging member 65Y, the photoreceptor 61Y, the cleaning unit 62Y, and the developing unit 64Y for a yellow color are integrated to form a process cartridge 100Y, respectively. By incorporating these 4 process cartridges in the image forming apparatus 1000', individual components of the process cartridges are provided in the image forming apparatus 1000'. The photoreceptors 61K, 61C, 61M and 61Y provided on the process cartridges 100K, 100C, 100M and 100Y, respectively, correspond to an example of the photoreceptor of the present exemplary embodiment.

The image forming apparatus 1000' includes an intermediate transfer belt 5 serving as an intermediate transfer body that conveys a primary transferred image after transferring a toner image of each color formed on each photoreceptor (primary transfer); primary transfer rolls 50K, 50C, 50M and 50Y that perform primary transfer of the toner image of each color to the intermediate transfer belt 5; a secondary transfer roll pair 9 that performs secondary transfer to a paper; a fixing unit 10' as a fixing unit that fixes the toner image formed by the secondary transfer on the paper; four toner cartridges 4K, 4C, 4M and 4Y that supply a toner of each color component to the four developing units, respectively; and a tray 1' that stores paper.

The transfer medium in the present exemplary embodiment is not specifically limited, as long as a toner image formed on the electrophotographic photoreceptor can be transferred thereon. For example, when an image is directly transferred from the electrophotographic photoreceptor onto a transfer medium such as paper, paper or the like refers to a transfer medium. When an intermediate transfer body is used, the intermediate transfer body refers to a transfer medium.

The intermediate transfer belt 5 is driven by a drive force from a drive roll 5*a* to move in a direction indicated by an arrow A in a circular manner while being extended between a secondary transfer roll 9*b* and the drive roll 5*a*.

Although the intermediate transfer belt 5 is used as an intermediate transfer body in the above description, the intermediate transfer body may be either drum-shaped or belt-shaped as in the intermediate transfer belt 5. When the intermediate transfer body is in the form of a belt, a polymer material for the base material for the intermediate transfer body may be a conventional known polymer. Examples thereof include a polyimide polymer, a polycarbonate polymer (PC), a polyvinylidene fluoride (PVDF), a polyalkylene terephthalate (PAT), blend materials such as a blend material of an ethylene tetrafluoroethylene copolymer (ETFE)/PC, an ETFE/PAT or a PC/PAT, polymer materials such as polyester, polyether ether ketone or polyamide, and polymer materials formed from these materials as a main raw material. Further, a blend of a polymer material and an elastic material may be used.

Examples of the material for the cleaning blade of the present exemplary embodiment include a urethane rubber (polyurethane elastomer), a silicone rubber, a fluorinated rubber, a chloroprene rubber, and a butadiene rubber. Among them, a urethane rubber (polyurethane elastomer) is preferably used from the viewpoint of excellent abrasion resistance.

Next, the operation for forming an image in the image forming apparatus 1000' is explained.

The four photoreceptors 61K, 61C, 61M, and 61Y are charged by the charging members 65K, 65C, 65M, and 65Y, respectively, and an electrostatic latent image is formed on each photoreceptor by laser light irradiated from the exposure units 7K, 7C, 7M, and 7Y. The formed electrostatic latent image is developed with a developer containing a toner of each color by the developing units 64K, 64C, 64M, and 64Y, thereby forming a toner image. The thus foliated toner images of respective colors are then sequentially transferred and superimposed onto the intermediate transfer belt 5 in the order of yellow (Y), magenta (M), cyan (C) and black (K), at the primary transfer rolls 50K, 50C, 50M and 50Y corresponding to each color (primary transfer), thereby forming a multicolor primary transferred image.

Subsequently, the multicolor primary transferred image is conveyed to the secondary transfer roll pair 9 by the intermediate transfer belt 5. In synchronism with the formation of the multicolor primary transferred image, a paper is taken out from the tray 1', and conveyed by the feed roll 3, and the position of the paper is adjusted by a registration roll pair 8. The multicolor primary transferred image is then transferred onto the paper that has been conveyed by the secondary transfer roll pair 9 (secondary transfer). Thereafter, the secondary transferred image on the paper is subjected to a fixing treatment by a fixing unit 10'. After the fixing treatment, the paper with the fixed image is passed through a discharge roll pair 13 and discharged into a paper discharge tray 2.

When the image formation is carried out by the above-mentioned operation in the image forming apparatus 1000', the cleaning blades contained in the cleaning units 62K, 62C, 62M, and 62Y, respectively, contact the rotating electrophotographic photoreceptors 61K, 61C, 61M, and 61Y, respectively, to remove residual toner. The occurrence of noise is effectively suppressed since the image forming apparatus 1000' includes the photoreceptor of the present exemplary embodiment.

Process Cartridge

The process cartridge of the present exemplary embodiment includes the electrophotographic photoreceptor according to the present exemplary embodiment and a cleaning unit having a cleaning blade that removes residual toner remaining on the surface of the electrophotographic photoreceptor after transferring, to the transfer medium, the toner image formed on the surface of the electrophotographic photoreceptor. Further, the process cartridge of the present exemplary embodiment is detachably mounted to an image forming apparatus. That is, the process cartridge is detachable. Further, the process cartridge of the present exemplary embodiment may further include at least one selected from the group consisting of a charging unit that charges the surface of the electrophotographic photoreceptor, an electrostatic latent image forming unit that forms an electrostatic latent image on the surface of the charged electrophotographic photoreceptor, and an image forming unit that forms a toner image by developing the electrostatic latent image formed on the surface of the electrophotographic photoreceptor with a developer containing a toner.

Figure 4:
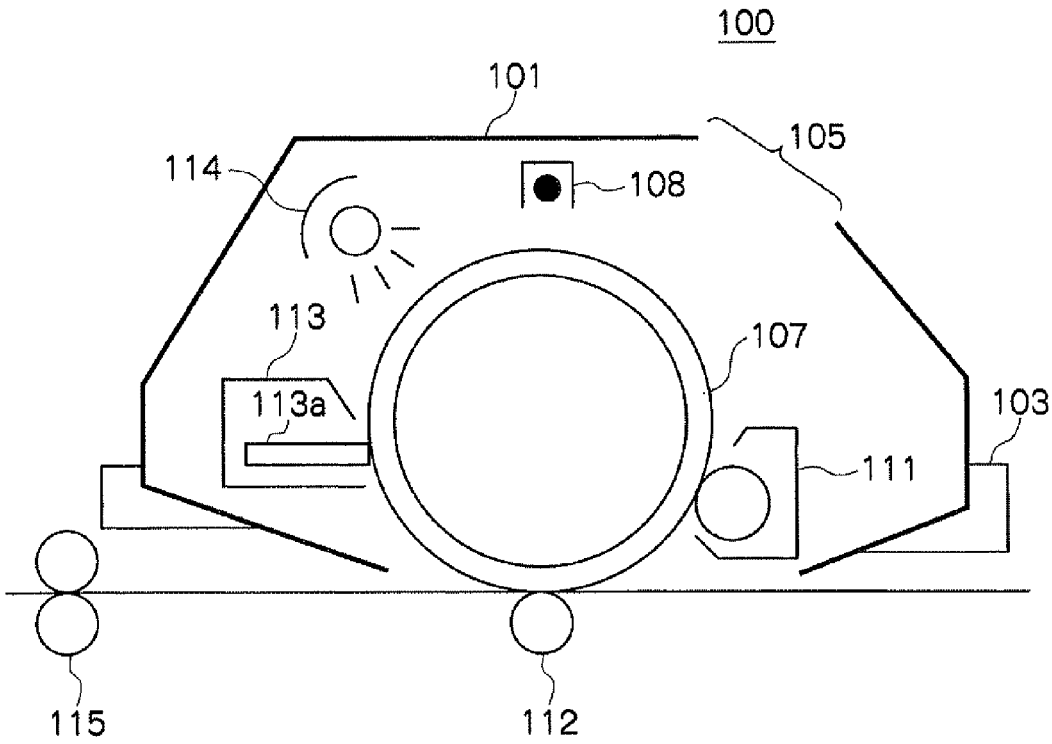
FIG. 4 is a schematic constitutional view showing an example of a process cartridge according to an exemplary embodiment of the present invention.

FIG. 4 is a schematic view illustrating an example of a basic configuration of the process cartridge of the present exemplary embodiment.

The process cartridge 100 includes an electrophotographic photoreceptor 107 of the present exemplary embodiment, a charging unit 108, a developing unit 111, a cleaning unit 113, an opening part 105 for exposure and a static erasing unit 114, which are combined and integrated by a container 101 and a fixing rail 103. The process cartridge 100 is detachable from and attachable to an image forming apparatus including a transfer unit 112, a fixing unit 115, and other components not shown in the figure. The process cartridge 100 forms a part of an image forming apparatus together with the main body of the image forming apparatus.

The cleaning blade 113*a* contained in the cleaning unit 113 contacts the rotating electrophotographic photoreceptor 107 to remove residual toner. The occurrence of noise is effectively suppressed since the photoreceptor of the present exemplary embodiment is included.

EXAMPLES

Hereinafter, the invention will be described in greater detail with reference to the Examples and Comparative Examples. However, it is to be understood that the invention is not restricted to these Examples.

Example 1

100 parts by weight of zinc oxide particles (average particle diameter: 70 nm, manufactured by Tayca Corporation, specific surface area: 15 $m^2/g$) is mixed with 500 parts by weight of methanol while stirring, and 1.25 parts by weight of a silane coupling agent, KBM603 (manufactured by Shin-Etsu Chemical Co., Ltd.) is added thereto, followed by stirring for 2 hours. Thereafter, methanol is distilled away under reduced pressure and baking is performed at 120° C. for 3 hours, thereby obtaining zinc oxide particles which are surface-treated with a silane coupling agent.

38 parts by weight of a solution, which is prepared by dissolving 60 parts by weight of the above surface-treated zinc oxide particles, 0.6 parts by weight of alizarin, 13.5 parts by weight of a blocked isocyanate (SUMIJOULE 3173, manufactures by Sumitomo Bayer Urethane Co., Ltd.) as a curing agent and 15 parts by weight of a butyral polymer (BM-1, manufactured by Sekisui Chemical Co., Ltd.) in 85 parts by weight of methyl ethyl ketone, is mixed with 25 parts by weight of methyl ethyl ketone, and the mixture is dispersed for 4 hours by a sand mill with glass beads having a diameter of 1 mm to obtain a dispersion liquid. To the obtained dispersion liquid are added 0.005 parts by weight of dioctyltin dilaurate as a catalyst and 4.0 parts by weight of silicone polymer particles (TOSPEARL 145, manufactured by GE Toshiba Silicones Co., Ltd.) to obtain a coating liquid for forming an undercoat layer. The obtained coating liquid is applied onto an aluminum substrate having a diameter of 24 mm by a dip coating method, and the formed coating is dried and cured at 180° C. for 40 minutes, thereby forming an undercoat layer with a thickness of 23.5 μm.

Next, a mixture of 15 parts by weight of a hydroxygallium phthalocyanine crystal having intense diffraction peaks at least at 7.5°, 9.9°, 12.5°, 16.3°, 18.6°, 25.1° and 28.3° of Bragg angles (2θ±0.2°) relative to CuKα characteristic X rays as a charge generating material, 10 parts by weight of a vinyl chloride-vinyl acetate copolymer (VMCH, manufactured by Union Carbide Japan KK) and 300 parts by weight of n-butyl alcohol is dispersed for 4 hours by a sand mill with glass beads having a diameter of 1 mm to obtain a coating liquid for forming a charge generation layer. The coating liquid for forming a charge generation layer is applied onto the undercoat layer by a dip coating method and dried, thereby forming a charge generation layer with a thickness of 0.2 μm.

Next, a liquid A (a suspension of tetrafluoroethylene polymer particles) is prepared by mixing 0.5 parts by weight of tetrafluoroethylene polymer particles (average primary particle diameter: 0.03 μm) and 0.01 parts by weight of a fluoroalkyl group-containing copolymer having repeating units represented by the following formula A and formula B (weight average molecular weight: 50,000, l:m=1:1, and n=60) with 4 parts by weight of tetrahydrofuran and 1 part by weight of toluene, and agitating the mixture for 48 hours while maintaining the liquid temperature at 20° C.

Further, as charge transport materials, a liquid B is prepared by mixing 2 parts by weight of N,N'-bis(3-methylphenyl)-N,N'-diphenyl benzidine, 2 parts by weight of N,N'-bis(3,4-dimethylphenyl)biphenyl-4-amine, and 6 parts by weight of a bisphenol Z-type polycarbonate polymer (viscosity average molecular weight: 40,000), and 0.1 parts by weight of 2,6-di-t-butyl-4-methyl phenol as an antioxidant, and dissolving the mixture in 24 parts by weight of tetrahydrofuran and 11 parts by weight of toluene. After adding the liquid A to the liquid B and mixing while stirring, the mixture is subjected to a dispersion treatment by increasing the pressure to 500 kgf/cm$^2$ using a high-pressure homogenizer having a passing-through chamber with fine flow paths (manufactured by Yoshida Kikai Co., Ltd.). The dispersion treatment is repeated six times. To this liquid is added a dimethyl silicone oil (KP-340, trade mark, manufactured by Shin-Etsu Silicone Co., Ltd.) in an amount of 5 ppm, and the mixture is sufficiently stirred. A coating liquid for forming a charge transport layer is thus obtained.

Formula A

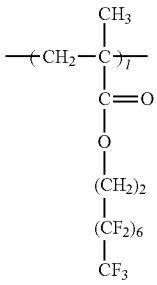

-continued

Formula B

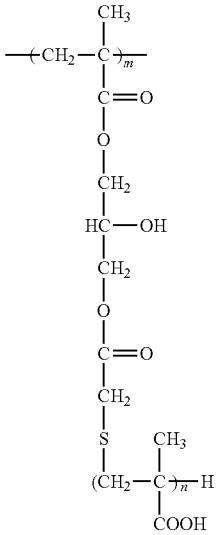

The coating liquid for forming a charge transport layer is applied onto the charge generation layer by a dip coating method and dried at 135° C. for 25 minutes to form a charge transport layer with a thickness of 22 μM, thereby obtaining a desired electrophotographic photoreceptor.

The thus obtained electrophotographic photoreceptor is subjected to the following tests. The results are shown in Table 1.

Evaluation of PTFE Dispersibility in Layer

The surface of the obtained photoreceptor is observed by visual examination. Observation is made of the entire surface of the photoreceptor, and whether or not aggregation of fluorine-containing polymer particles occurs in the layer is evaluated.

Evaluation of Surface Roughness

Surface roughness of the obtained photoreceptor is measured by a SURFCOM roughness meter (manufactured by Tokyo Seimitsu Co., Ltd.) with a measuring stylus of 0.2 μmR. Measurement is performed at a tensile rate of 0.3 min/sec over at a measurement length of 4 mm. Measurement is made at four sites in the circumferential direction at each of different locations at distance of 35 mm, 180 mm, and 330 mm, respectively from one end of the photoreceptor in the axial direction, i.e. at a total of 12 sites. An average interval between convex portions (protrusions) having diameters of 200 μm or more present on the surface is defined as Sm.

In addition, the sizes of convex portions having diameters of 200 μm or more are measured under a light microscope, and diameter (average value) of the convex portions is calculated.

As a result, convex portions having diameters of greater than 500 μm are not observed.

Evaluation of Abnormal Sounds

The photoreceptor is mounted on a remodeled DocuPrint C1100 (manufactured by Fuji Xerox Co., Ltd.) equipped with a contact type DC voltage charging system and a low voltage transfer system. According to the criteria to be illustrated hereinafter, organoleptic evaluation is performed on noise occurring at the contact region between the photoreceptor and the cleaning blade, at initiation of printing and after continuous printing of 10 paper sheets in the A4 paper width direction as a paper conveyance direction. The results of this Example are shown in Table 1.

Figure 5A:
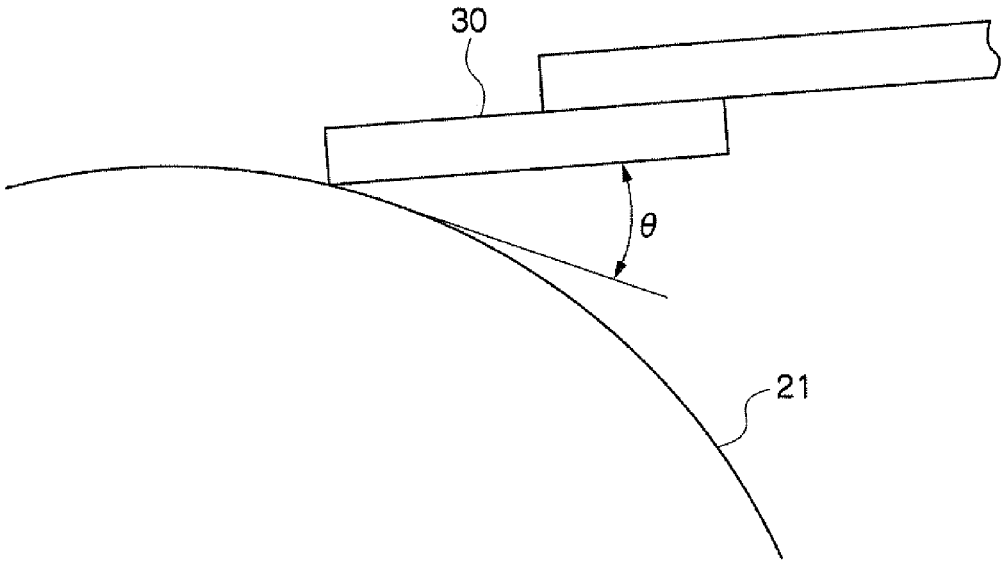
FIG. 5A and FIG. 5B are views showing the blade setting angle θ and the blade contact angle α.
Figure 5B:
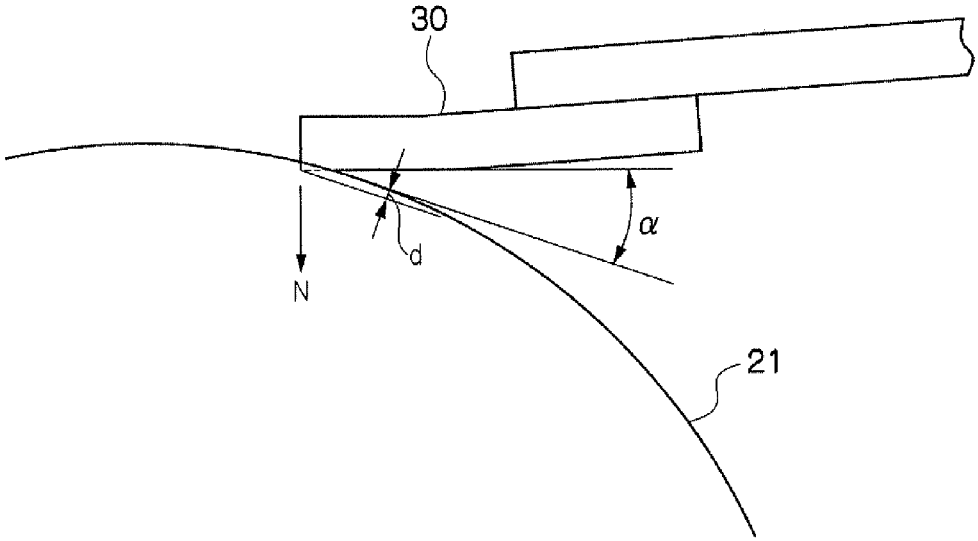

Further, as a cleaning parameter, a blade is defined to be made of polyurethane, a free length L': 7.0 mm, a blade thickness T: 2.0 mm and a blade Young's modulus E: 65 kg/cm$^2$. The blade setting angle θ is set to 25.90°, and the penetration amount d is set to 1.3 mm. The contact line pressure N is set to 4.93 gf/mm (0.0483 N/mm), and the blade contact angle α is set to 10.33°. The evaluation is performed at the above condition. Here, the blade setting angle θ, as shown in FIG. 5A, represents an angle θ between the front end of the cleaning blade 30 and the tangent line with the photoreceptor 21 when the cleaning blade penetration amount d is considered to be 0 mm. The blade contact angle α, as shown in FIG. 5B, represents an angle α between the front end 30 and the tangent line at the contact site of the cleaning blade and the photoreceptor 21, under the condition where the cleaning blade is penetrated.

The occurrence of noise is measured by organoleptic evaluation method in a room that is excluded from the outside sounds such that only the operation sound of evaluation equipment is audible. Measurement is made according to the following criteria.

A: only the operation sound of evaluation equipment is audible.

B: slight noise of the blade is audible in addition to the operation sound of evaluation equipment.

C: noise of the blade is severe and is determined as a harsh grating noise.

Evaluation of Image Quality

The photoreceptor is mounted on a modified DocuPrint C1100 (manufactured by Fuji Xerox Co., Ltd.) equipped with a contact type DC voltage charging system and a low voltage transfer system. Printing is performed on one sheet of A4 blank paper in the A4 paper width direction as a paper conveyance direction, and an initial printing test is carried out. Here, in the initial printing test (blank sheet), the occurrence of black spots is visually examined. In addition, in the printing test (1 dot line reproducibility) after continuous printing of 5000 sheets in the A4 paper width direction as a paper conveyance direction, a radial pattern of 1 dot line is formed and the line reproducibility is visually evaluated. The results of this Example are shown in Table 1.

Image Quality Evaluation: 1 Dot Line Reproducibility

A: line reproducibility observed

B: line reproducibility not observed

Example 2

A coating liquid for forming a charge transport layer is prepared in the same manner as in Example 1, except that 0.5 parts by weight of tetrafluoroethylene polymer particles (average primary particle diameter: 0.03 μm) used in the preparation of the coating liquid for forming a charge transport layer is changed to 0.5 parts by weight of tetrafluoroethylene polymer particles (average primary particle diameter: 0.02 μm). The obtained electrophotographic photoreceptor is evaluated in the same manner as in Example 1. The results are shown in Table 1.

Comparative Example 1

A coating liquid for forming a charge transport layer is prepared in the same manner as in Example 1, except that 0.5 parts by weight of tetrafluoroethylene polymer particles (average primary particle diameter: 0.03 μm) used in the preparation of the coating liquid for forming a charge transport layer is changed to 0.5 parts by weight of tetrafluoroethylene polymer particles (average primary particle diameter: 0.05 μm). The obtained electrophotographic photoreceptor is evaluated in the same manner as in Example 1. The results are shown in Table 1.

Comparative Example 2

A coating liquid for forming a charge transport layer is prepared in the same manner as in Example 1, except that 0.5 parts by weight of tetrafluoroethylene polymer particles (average primary particle diameter: 0.03 μm) used in the preparation of the coating liquid for forming a charge transport layer is changed to 0.5 parts by weight of tetrafluoroethylene polymer particles (average primary particle diameter: 0.5 μm). The obtained electrophotographic photoreceptor is evaluated in the same manner as in Example 1. The results are shown in Table 1.

Comparative Example 3

A coating liquid for forming a charge transport layer is prepared in the same manner as in Example 1, except that 0.5 parts by weight of tetrafluoroethylene polymer particles (average primary particle diameter: 0.03 μm) used in the preparation of the coating liquid for forming a charge transport layer is changed to 0.5 parts by weight of tetrafluoroethylene polymer particles (average primary particle diameter: 1.0 μm). The obtained electrophotographic photoreceptor is evaluated in the same manner as in Example 1. The results are shown in Table 1. Since convex portions having diameters of 200 μm or more are not present in Comparative Examples 1-3, the sizes of convex portions having diameters of 30 μm or more are measured under a light microscope, and diameter (average value) of the convex portions is calculated.

Example 3

A coating liquid for forming a charge transport layer is prepared in the same manner as in Example 1, except that the fluoroalkyl group-containing copolymer is changed to a fluoroalkyl group-containing copolymer having a repeating unit represented by the following formula C (weight average molecular weight of 50,000, l:m=1:1, n=60). The obtained electrophotographic photoreceptor is evaluated in the same manner as in Example 1. The results are shown in Table 1.

FORMULA C

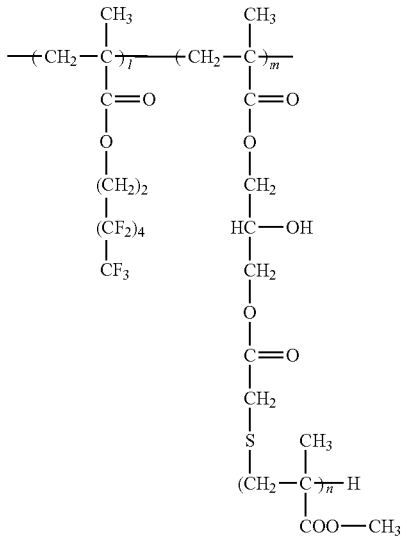

Example 4

A coating liquid for forming a charge transport layer is prepared in the same manner as in Example 1, except that the fluoroalkyl group-containing copolymer is changed to a fluoroalkyl group-containing copolymer having a repeating unit represented by the following formula D (weight average molecular weight of 50,000, l:m=1:1, n=60). The obtained electrophotographic photoreceptor is evaluated in the same manner as in Example 1. The results are shown in Table 1.

FORMULA D

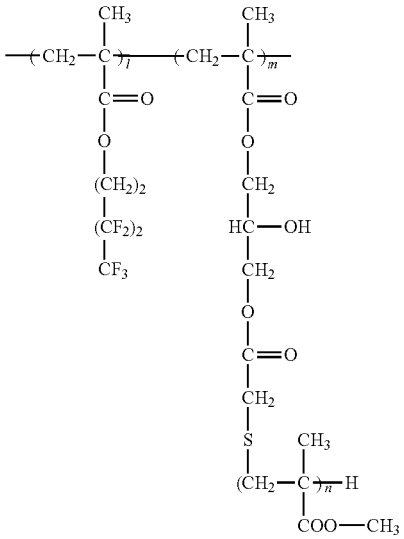

Example 5

A coating liquid for forming a charge transport layer is prepared in the same manner as in Example 1, except that the tetrafluoroethylene polymer particles are changed to vinylidene fluoride polymer particles (average primary particle diameter: 0.03 μm). The obtained electrophotographic photoreceptor is evaluated in the same manner as in Example 1. The results are shown in Table 1.

Example 6

A coating liquid for forming a charge transport layer is prepared in the same manner as in Example 1, except that a content of the fluoroalkyl group-containing copolymer having repeating units represented by the above formula 1 and formula 2 (weight average molecular weight of 50,000, l:m=1:1, n=60) is changed to 0.008 parts by weight. The obtained electrophotographic photoreceptor is evaluated in the same manner as in Example 1. The results are shown in Table 1.

Example 7

A coating liquid for forming a charge transport layer is prepared in the same manner as in Example 1, except that a content of the fluoroalkyl group-containing copolymer having repeating units represented by the above formula 1 and formula 2 (weight average molecular weight of 50,000, l:m=1:1, n=60) is changed to 0.005 parts by weight. The obtained electrophotographic photoreceptor is evaluated in the same manner as in Example 1. The results are shown in Table 1.

Comparative Example 4

A coating liquid for forming a charge transport layer is prepared in the same manner as in Example 1, except that a content of the fluoroalkyl group-containing copolymer having repeating units represented by the above formula 1 and formula 2 (weight average molecular weight of 50,000, l:m=1:1, n=60) is changed to 0.015 parts by weight. The obtained electrophotographic photoreceptor is evaluated in the same manner as in Example 1. The results are shown in Table 1.

Comparative Example 5

A coating liquid for forming a charge transport layer is prepared in the same manner as in Example 1, except that a content of the fluoroalkyl group-containing copolymer having repeating units represented by the above formula 1 and formula 2 (weight average molecular weight of 50,000, l:m=1:1, n=60) is changed to 0.02 parts by weight. The obtained electrophotographic photoreceptor is evaluated in the same manner as in Example 1. The results are shown in Table 1.

Comparative Example 6

A coating liquid for forming a charge transport layer is prepared in the same manner as in Example 1, except that the dispersion treatment by increasing the pressure to 500 kgf/cm$^2$ using a high-pressure homogenizer is repeated 3 times. The obtained electrophotographic photoreceptor is evaluated in the same manner as in Example 1. The results are shown in Table 1.

TABLE 1

| | Dispersibility of PTFE in charge transport layer | Surface roughness Sm (μm) | Diameter of convex portion (μm) | Image quality evaluation (Presence or absence of black spots) | Image quality evaluation (Line reproducibility) | Evaluation of abnormal sounds |
|---|---|---|---|---|---|---|
| Example 1 | Aggregated | 600 | 200 | No | A | A |
| Example 2 | Aggregated | 650 | 250 | No | A | A |
| Comparative Example 1 | No aggregation | 230 | 100 | No | B | B |
| Comparative Example 2 | No aggregation | 180 | 70 | No | B | B |
| Comparative Example 3 | No aggregation | 100 | 45 | No | B | C |
| Example 3 | Aggregated | 700 | 300 | No | A | A |

TABLE 1-continued

| | Dispersibility of PTFE in charge transport layer | Surface roughness Sm (μm) | Diameter of convex portion (μm) | Image quality evaluation (Presence or absence of black spots) | Image quality evaluation (Line reproducibility) | Evaluation of abnormal sounds |
|---|---|---|---|---|---|---|
| Example 4 | Aggregated | 600 | 300 | No | A | A |
| Example 5 | Aggregated | 650 | 350 | No | A | A |
| Example 6 | Aggregated | 900 | 200 | No | A | A |
| Example 7 | Aggregated | 950 | 300 | No | A | A |
| Comparative Example 4 | Aggregated | 550 | 210 | No | B | B |
| Comparative Example 5 | Aggregated | 580 | 250 | No | B | B |
| Comparative Example 6 | Aggregated | 1200 | 200 | Yes | B | A |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor, comprising:

a substrate; and a photosensitive layer disposed on the substrate, wherein a surface layer of the electrophotographic photoreceptor contains fluorine-containing polymer particles and a dispersion aid for the fluorine-containing polymer particles, and the surface layer has convex portions with diameters of from about 200 μm to about 500 μm spaced at an average interval of from about 600 μm to about 950 μm.

2. The electrophotographic photoreceptor according to claim 1, wherein an average diameter of the convex portions is from about 200 μm to about 350 μm.

3. The electrophotographic photoreceptor according to claim 1, wherein the dispersion aid is a copolymer containing repeating units represented by the following chemical formula (1) and chemical formula (2):

CHEMICAL FORMULA (1)

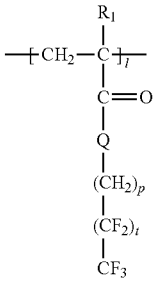

-continued

CHEMICAL FORMULA (2)

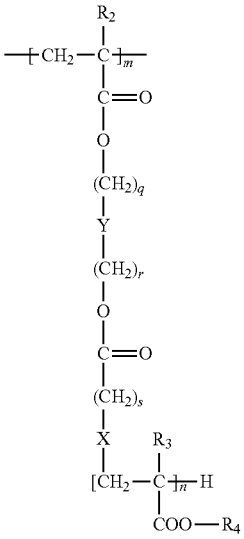

wherein, in chemical formula (1) and chemical formula (2), l, m and n each independently represent a positive integer of 1 or more, p, q, r and s independently each represent 0 or a positive integer of 1 or more, t represents a positive integer of from 2 to 7, $R_1$, $R_2$, $R_3$ and $R_4$ each independently represent a hydrogen atom or an alkyl group, X represents an alkylene chain, a halogen-substituted alkylene chain, —S—, —O—, —NH— or a single bond, Y represents an alkylene chain, a halogen-substituted alkylene chain, —($C_zH_{2z-1}$(OH))— or a single bond, z represents a positive integer of 1 or more, and Q represents —O—.

4. The electrophotographic photoreceptor according to claim 3, wherein the average diameter of the convex portions is from about 200 μm to about 350 μm.

5. The electrophotographic photoreceptor according to claim 1, wherein the fluorine-containing polymer particles are particles selected from a tetrafluoroethylene polymer (PTFE), a trifluorochloroethylene polymer, a hexafluoropropylene polymer, a vinyl fluoride polymer, a vinylidene fluoride polymer, a difluorodichloroethylene polymer or copolymers thereof.

6. The electrophotographic photoreceptor according to claim 1, wherein the average primary particle diameter of the fluorine-containing polymer particles is in a range of from about 0.01 μm to about 0.04 μm.

7. The electrophotographic photoreceptor according to claim 1, wherein the content of the fluorine-containing polymer particles is in a range of from about 1% by weight to about 15% by weight relative to the total solid content of the surface layer.

8. The electrophotographic photoreceptor according to claim 1, wherein the content of the dispersion aid is in a range of from about 1% by weight to about 5% by weight relative to the content of the fluorine-containing polymer particles in the surface layer.

9. The electrophotographic photoreceptor according to claim 1, wherein the fluorine-containing polymer particles are aggregates in the surface layer.

10. The electrophotographic photoreceptor according to claim 1, wherein the surface layer is a part of the photosensitive layer or is an overcoat layer.

11. The electrophotographic photoreceptor according to claim 1, wherein the surface layer is a charge transport layer.

12. A process cartridge which is attachable to and detachable from an image forming apparatus that forms an image on a recording medium, the process cartridge comprising a cleaning unit and the electrophotographic photoreceptor according to claim 1.

13. The process cartridge according to claim 12, wherein the average diameter of the convex portions of the electrophotographic photoreceptor is from about 200 μm to about 350 μm.

14. The process cartridge according to claim 12, wherein the dispersion aid of the electrophotographic photoreceptor is a copolymer containing repeating units represented by the following chemical formula (1) and chemical formula (2):

CHEMICAL FORMULA (1)

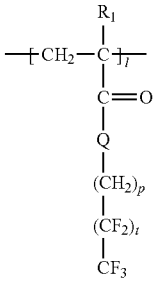

CHEMICAL FORMULA (2)

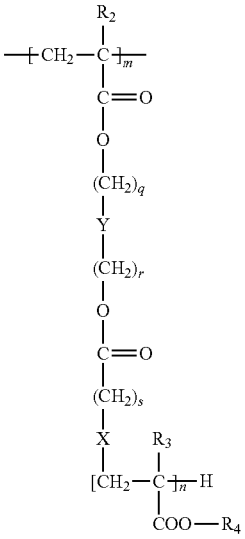

wherein in chemical formula (1) and chemical formula (2), l, m and n each independently represent a positive integer of 1 or more, p, q, r and s each independently represent 0 or a positive integer of 1 or more, t represents a positive integer of from 2 to 7, $R_1$, $R_2$, $R_3$ and $R_4$ each independently represent a hydrogen atom or an alkyl group, X represents an alkylene chain, a halogen-substituted alkylene chain, —S—, —O—, —NH— or a single bond, Y represents an alkylene chain, a halogen-substituted alkylene chain, —($C_zH_{2z-1}$(OH))— or a single bond, z represents a positive integer of 1 or more, and Q represents —O—.

15. The process cartridge according to claim 12, wherein the fluorine-containing polymer particles of the electrophotographic photoreceptor are particles selected from a tetrafluoroethylene polymer (PTFE), a trifluorochloroethylene polymer, a hexafluoropropylene polymer, a vinyl fluoride polymer, a vinylidene fluoride polymer, a difluorodichloroethylene polymer or copolymers thereof.

16. An image forming apparatus comprising:

the electrophotographic photoreceptor according to claim 1;

a charging unit that charges the electrophotographic photoreceptor;

a latent image forming unit that forms an electrostatic latent image on a surface of the charged electrophotographic photoreceptor;

a developing unit that forms a toner image by developing the electrostatic latent image formed on the surface of the electrophotographic photoreceptor with a toner; and a transferring unit that transfers, to a recording medium, the toner image formed on the surface layer of the electrophotographic photoreceptor.

17. The image forming apparatus according to claim 16, wherein the average diameter of the convex portions of the electrophotographic photoreceptor is from about 200 μm to about 350 μm.

18. The image forming apparatus according to claim 16, wherein the dispersion aid of the electrophotographic photoreceptor is a copolymer containing repeating units represented by the following chemical formula (1) and chemical formula (2):

CHEMICAL FORMULA (1)

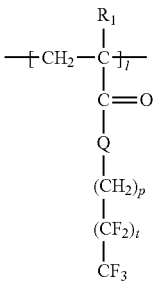

-continued

CHEMICAL FORMULA (2)

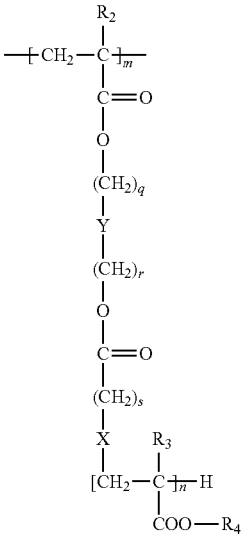

wherein in chemical formula (1) and chemical formula (2), l, m and n each independently represent a positive integer of 1 or more, p, q, r and s each independently represent 0 or a positive integer of 1 or more, t represents a positive integer of from 2 to 7, $R_1$, $R_2$, $R_3$ and $R_4$ each independently represent a hydrogen atom or an alkyl group, X represents an alkylene chain, a halogen-substituted alkylene chain, —S—, —O—, —NH— or a single bond, Y represents an alkylene chain, a halogen-substituted alkylene chain, —($C_zH_{2z-1}$(OH))— or a single bond, z represents a positive integer of 1 or more, and Q represents —O—.

19. The image forming apparatus according to claim 16, wherein the fluorine-containing polymer particles of the electrophotographic photoreceptor are particles selected from a tetrafluoroethylene polymer (PTFE), a trifluorochloroethylene polymer, a hexafluoropropylene polymer, a vinyl fluoride polymer, a vinylidene fluoride polymer, a difluorodichloroethylene polymer or copolymers thereof.

* * * * *